US005590480A

United States Patent [19]

Bria et al.

[11] Patent Number: 5,590,480

[45] Date of Patent: Jan. 7, 1997

[54] COMBINATION AIR BAR AND HOLE BAR FLOTATION DRYER

[75] Inventors: Michael P. Bria; Jeffrey D. Quass, both of Green Bay, Wis.

[73] Assignee: W. R. Grace & Co.-Conn., New York, N.Y.

[21] Appl. No.: 412,428

[22] Filed: Mar. 29, 1995

Related U.S. Application Data

[63] Continuation-in-part of Ser. No. 350,355, Dec. 6, 1994.

[51] Int. Cl.[6] ..... F26B 9/00

[52] U.S. Cl. ..... 34/629; 34/640

[58] Field of Search ..... 34/640, 629

[56] References Cited

U.S. PATENT DOCUMENTS

| | | | |
|---|---|---|---|
| 2,052,869 | 9/1936 | Coanda | 299/107 |
| 3,181,250 | 5/1965 | Vits | 34/23 |
| 3,199,224 | 8/1965 | Brown | 34/156 |
| 3,316,657 | 5/1967 | Haywood | 34/111 |
| 3,324,570 | 6/1967 | Faith et al. | 34/156 |
| 3,384,282 | 5/1968 | Vits | 226/97 |
| 3,485,429 | 12/1969 | Hutzenlaub | 226/97 |
| 3,549,070 | 12/1970 | Frost et al. | 226/97 |
| 3,587,177 | 6/1971 | Overly et al. | 34/156 |

(List continued on next page.)

FOREIGN PATENT DOCUMENTS

95/14199 5/1995 WIPO .

OTHER PUBLICATIONS

Drawing of Hole Bar Channel, TEC Systems, Inc. (Dec. 16, 1969).

Drawing of Hole Bar Channel, TEC Systems, Inc. (Dec. 5, 1970).

Drawing of Slot Bar Channel, TEC Systems, Inc. (Nov. 29, 1969).

Drawing of Bar Channel, TEC Systems, Inc. (Feb. 20, 1969).

Drawing of Tapered Nozzle Bar, TEC Systems, Inc. (Mar. 21, 1969).

General Specifications—Floater Dryer, TEC Systems, Inc. (Mar. 18, 1970.

Drawing of Bottom Hood Supply Header, TEC Systems, Inc. (May 2, 1969).

Drawing of Hole Plate, TEC Systems, Inc. (Mar. 27, 1969).

Drawing of Nozzle Layout, TEC Systems, Inc. (Aug. 21, 1973).

Drawing of Hood Assembly, TEC Systems, Inc. (no date visible).

Drawing of Hole Bar End Plate Assembly, TEC Systems, Inc. (Nov. 29, 1969).

Drawing of End Plate Assemblies, TEC Systems, Inc. (Feb. 21, 1969).

Drawing of Dryer Arrangement as Tested, TEC Systems, Inc. (Apr. 13, 1972).

Drawing of Standard Nozzle Arrangement, TEC Systems, Inc. (Apr. 20, 1978).

Drawing of Nozzle Section for Minimum Length, TEC Systems, Inc. (Dec. 16, 1969).

*Primary Examiner*—John T. Kwon

*Attorney, Agent, or Firm*—William L. Baker; Craig K. Leon; Kevin S. Lemack

[57] ABSTRACT

Apparatus and process for the non-contact drying of a web of material. The apparatus includes air flotation nozzles for floating the web, and direct air impingement nozzles for enhanced drying of the web. A plurality of air flotation nozzles or air bars are mounted in one or more sections of a dryer enclosure in air-receiving communication with headers, preferably both above and below the web for the contactless convection drying of the web. In conjunction with these air flotation nozzles, one or more sections of the dryer also includes direct impingement nozzles such as hole-array bars or slot bars. The drying surface of the web is thus heated by both air issuing from the air flotation nozzles and from the direct impingement nozzles. As a result, the dryer has a high rate of drying in a small, enclosed space while maintaining a comfortable working environment.

19 Claims, 11 Drawing Sheets

U.S. PATENT DOCUMENTS

| | | | |
|---|---|---|---|
| 3,650,043 | 3/1972 | Overly et al. | 34/156 |
| 3,705,676 | 12/1972 | Overly et al. | 226/97 |
| 3,711,960 | 1/1973 | Overly et al. | 34/156 |
| 3,739,491 | 6/1973 | Creapo et al. | 34/156 |
| 3,873,013 | 3/1975 | Stibbe | 226/97 |
| 3,936,953 | 2/1976 | Chance et al. | 34/160 |
| 3,957,187 | 5/1976 | Puigrodon | 226/7 |
| 3,964,656 | 6/1976 | Hella | 226/97 |
| 3,982,328 | 9/1976 | Gustafsson | 34/156 |
| 4,058,244 | 11/1977 | Vits | 226/97 |
| 4,069,595 | 1/1978 | Ahlbert et al. | 34/156 |
| 4,137,644 | 2/1979 | Karlsson | 34/23 |
| 4,142,661 | 3/1979 | Nettles et al. | 226/97 |
| 4,197,971 | 4/1980 | Stibbe | 226/97 |
| 4,197,973 | 4/1980 | Daane | 226/97 |
| 4,201,323 | 5/1980 | Stibbe et al. | 226/97 |
| 4,212,113 | 7/1980 | Andersson | 34/156 |
| 4,218,001 | 8/1980 | Vits | 226/97 |
| 4,218,833 | 8/1980 | Coar | 34/156 |
| 4,247,993 | 2/1981 | Lindstrom | 34/156 |
| 4,265,384 | 5/1981 | Daane | 226/97 |
| 4,271,601 | 6/1981 | Koponen et al. | 34/156 |
| 4,292,745 | 10/1981 | Caratsch | 34/156 |
| 4,320,587 | 3/1982 | Vits | 34/156 |
| 4,341,024 | 7/1982 | Witkin | 34/155 |
| 4,394,950 | 7/1983 | Kramer | 226/97 |
| 4,472,888 | 9/1984 | Spiller | 34/156 |
| 4,601,116 | 7/1986 | Krimsky | 34/156 |
| 4,767,042 | 8/1988 | Daane | 226/97 |
| 4,768,695 | 9/1988 | Stibbe | 226/97 |
| 4,785,985 | 11/1988 | Hurtgen | 226/97 |
| 4,785,986 | 11/1988 | Daane et al. | 226/97 |
| 4,787,547 | 11/1988 | Hella et al. | 226/97 |
| 4,790,468 | 12/1988 | Nakashima et al. | 226/97 |
| 4,804,125 | 12/1989 | Vits | 226/97 |
| 4,824,002 | 4/1989 | Ford et al. | 226/197 |
| 4,901,449 | 2/1990 | Wimberger | 34/156 |
| 5,152,080 | 10/1992 | Wimberger | 34/156 |

COMBINATION AIR BAR AND HOLE BAR FLOTATION DRYER

This applications is a continuation-in-part of Ser. No. 08/350,355, filed Dec. 6, 1994.

BACKGROUND OF THE INVENTION

The present invention relates to web supporting and drying apparatus. In drying a moving web of material, such as paper, film or other sheet material, it is often desirable to contactlessly support the web during the drying operation in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly sub-atmospheric pressure by an exhaust blower that draws off the volatiles emanating from the web as a result of the drying of the ink thereon, for example.

One example of such a dryer can be found in U.S. Pat. No. 5,207,008, the disclosure of which is hereby incorporated by reference. That patent discloses an air flotation dryer with a built-in afterburner, in which a plurality of air bars are positioned above and below the traveling web for the contactless drying of web coating. In particular, the air bars are in air-receiving communication with an elaborate header system, and blow air towards the web so as to support and dry the web as it travels through the dryer enclosure.

Various attempts have been made in the prior art for decreasing the length and/or increasing the efficiency and line speed of such dryers. To that end, infrared radiation has been used either alone or in combination with air to dry the web. However, installing infrared radiation means in conventional convection dryers is often difficult and the equipment is expensive to purchase and to operate.

U.S. Pat. No. 4,698,914 discloses a dryer having a series of sections, each section having at least one push-type and one draw-type gas discharge device, such as an air bar and an air foil, respectively. The push-type device is arranged so as to cause gas to impinge the side of the web opposite the coated side and at an angle of substantially 90° relative to the transport direction of the web. The draw-type device is arranged so as to cause gas to impinge the side of the web opposite the coated side at an angle of about 0.5 to 5.0° relative to the transport direction of the moving web. As a result, web clearance is increased and web defects reduced.

U.S. Pat. No. 3,979,038 discloses a flotation dryer including a plurality of blow boxes provided with apertures for air outflow against a floating web, and fixing chambers mounted at a smaller distance from the web than the blow boxes. The fixing chambers have apertures directed obliquely to the plane of the web, and at least one blow box with apertures distributed over its plane is mounted directly in front of a fixing chamber.

The present invention relates to a web flotation dryer and a process for floatingly drying a traveling web, wherein a combination of air bars and hole bars are used. Although more nozzles may be used overall in the present invention, less air bars are used. This is advantageous in view of the precise tolerance that air bars require, which add to their cost of manufacture. The use of hole bars also allows for a reduction in power requirements and operation at lower nozzle velocities without sacrificing heat transfer efficiency, and indeed, in some instances, enhancing heat transfer.

It is therefore an object of the present invention to improve the heat transfer process in an air flotation dryer without substantially increasing the capital or operating costs.

It is a further object of the present invention to achieve efficient heat transfer using the same or less total air volume per unit drying area than in a conventional dryer.

It is a still further object of the present invention to achieve efficient heat transfer while using lower air horsepower for a given heat transfer coefficient.

SUMMARY OF THE INVENTION

The problems of the prior art have been solved by the instant invention, which provides an apparatus and process for the non-contact drying of a web of material. The apparatus includes air flotation nozzles for floating the web, and direct air impingement nozzles for enhanced drying of the web. Specifically, a plurality of air flotation nozzles or air bars are mounted in one or more sections of a dryer enclosure in air-receiving communication with headers, preferably both above and below the web for the contactless convection drying of the web. In conjunction with these air flotation nozzles, one or more sections of the dryer also includes direct impingement nozzles such as hole-array bars or slot bars. The drying surface of the web is thus heated by both air issuing from the air flotation nozzles and from the direct impingement nozzles. As a result, the dryer has a high rate of drying in a small, enclosed space while maintaining a comfortable working environment.

DETAILED DESCRIPTION OF THE INVENTION

Although the present invention is not limited to any particular flotation nozzle design, it is preferred that flotation nozzles which exhibit the Coanda effect such as the HI-FLOAT® air bar commercially available from W. R. Grace & Co.-Conn. be used, in view of their high heat transfer and excellent flotation characteristics. Standard 1× HI-FLOAT® air bars are characterized by a spacing between slots of 2.5 inches; a slot width of 0.070 to 0.075 inches, usually 0.0725 inches; an installed pitch of 10 inches; and a web-to-air bar clearance of ⅛ inch. Air bar size can be larger or smaller. For example, air bars ½, 1.5, 2 and 4 times the standard size can be used. Air bars 2 times the standard size are characterized by a slot distance of 5 inches and slot widths of 0.140 to 0.145 inches (available commercially as "2× air bars" from W. R. Grace & Co.-Conn.). In general, the greater distance between the slots results in a larger air pressure pad between the air bar and the web, which allows for increasing the air bar spacing. Another suitable flotation nozzle that can be used in the present invention is the Tri-Flotation air bar disclosed in U.S. Pat. No. 4,901,449, the disclosure of which is herein incorporated by reference.

Means for creating direct air impingement on the web, such as a direct impingement nozzle having a plurality of apertures, such as a hole-array bar or slot bar, provides a higher heat transfer coefficient for a given air volume and nozzle velocity than a flotation nozzle. As between the hole-array bar and the slot bar, the former provides a higher heat transfer coefficient for a given air volume at equal nozzle velocities. Although maximum heat transfer is obviously a goal of any dryer system, other considerations such as air volume, nozzle velocity, air horsepower, proper web flotation, dryer size, web line speed, etc., influence the extent to which optimum heat transfer can be achieved, and thus the appropriate design of the direct impingement nozzle.

Figure 1:
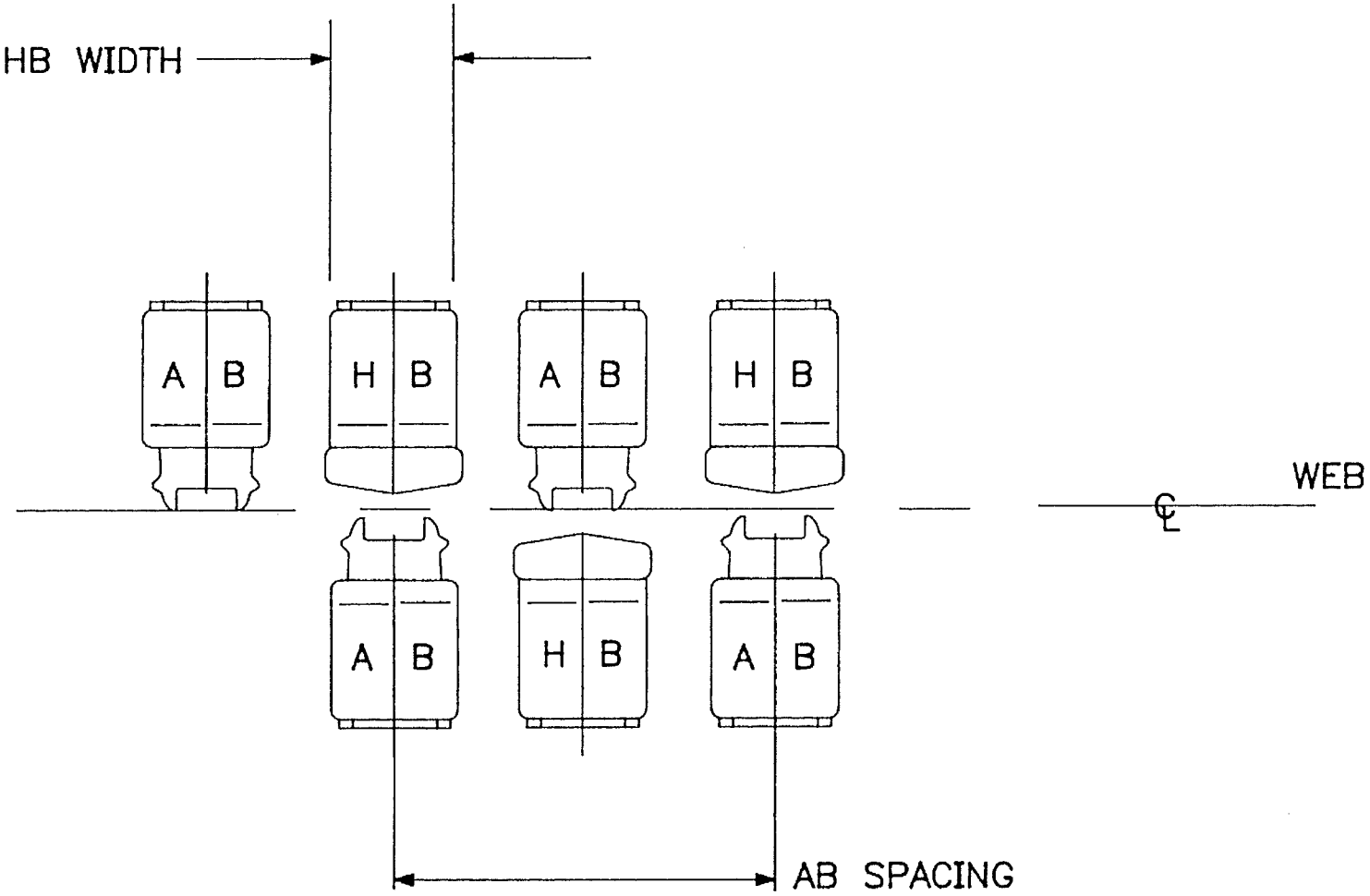
FIG. 1 is a schematic view of a flotation nozzle/direct impingement nozzle arrangement in accordance with a preferred embodiment of the present invention.

Turning now to FIG. 1, there is shown schematically a preferred flotation nozzle/direct impingement nozzle arrangement, with flotation nozzles or air bars denoted "AB" and direct impingement nozzles or hole bars denoted "HB". Horizontal web W is shown floatingly supported between upper and lower flotation nozzle/direct impingement nozzle arrays. In both the upper and lower arrays, each hole bar HB is positioned between two air bars AB. Opposite each hole bar HB is an air bar AB. This arrangement exhibits excellent heat transfer and web flotation characteristics. The distance between air bar AB centers, or "air bar pitch", should be between 10 and 30 inches, preferably 14 inches for the 1× air bar. This distance would scale proportionately for other air bar sizes such as a 2× air bar.

Figure 2:
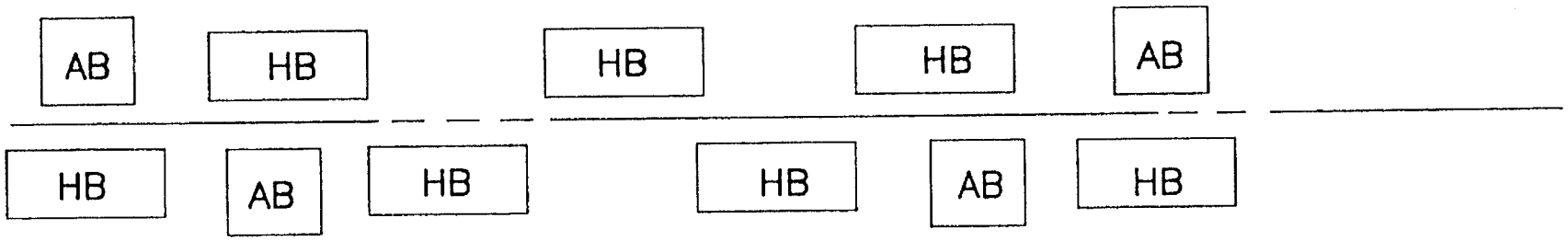
FIG. 2 is a schematic view of a flotation nozzle/direct impingement nozzle arrangement in accordance with an alternative embodiment of the present invention.

Another suitable flotation nozzle/direct impingement nozzle arrangement is shown schematically in FIG. 2, in which several of the hole bars do not have corresponding air bars or hole bars directly opposite them. It should be understood by those skilled in the art that the present invention is not limited to a particular flotation nozzle/direct impingement nozzle arrangement; any arrangement can be used depending upon the flotation and drying characteristics desired.

Figure 3:
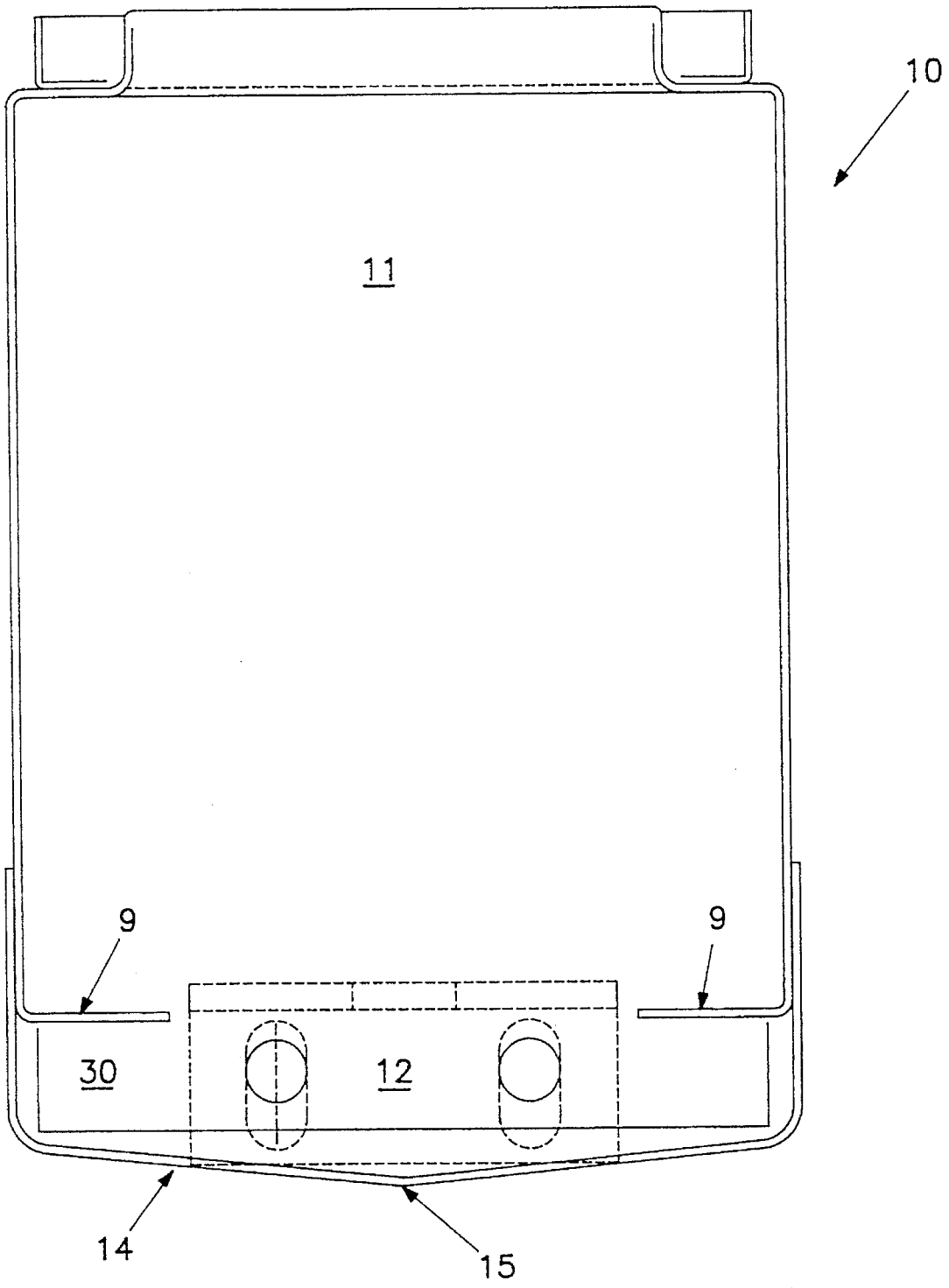
FIG. 3 is a cross-sectional view of a hole bar in accordance with the present invention.
Figure 4:
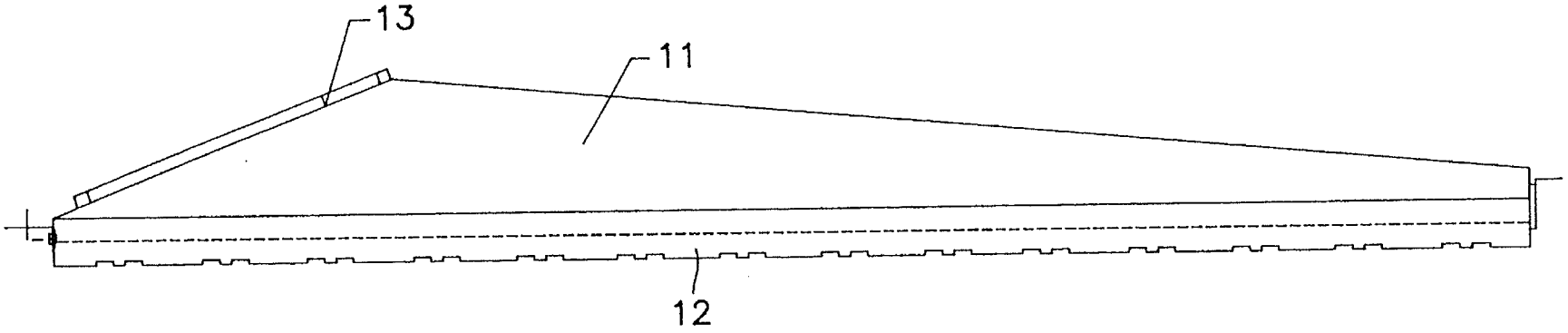
FIG. 4 is a side view of the hole bar of FIG. 3.

Turning now to FIGS. 3 and 4, a preferred embodiment of a direct impingement nozzle hole bar 10 is shown for graphic arts applications. Hole bar 10 is installed in air-receiving communication with a header 11 having a port 13. Header 11 feeds air into hole bar compartment 12. The air emits from the hole bar 10 via a plurality of apertures, in this case spaced circular holes in the top surface 14 of the hole bar 10. Preferably the top surface 14 of hole bar 10 is crown shaped and approaches a central apex 15 at about a 5° angle. This design encourages the return air to flow over the edges of the hole bar 10 after impingement on the web W. A flatter top surface 14 tends to result in return air traveling down the face of the hole bar in the cross-web direction, which is undesirable. The angle of the crown can vary from about 0° to about 10°. In general, the closer the hole bar is to the web, the larger the angle of the crown. Hole bars at a large distance from the web could be flat.

The particular pattern and configuration of apertures in the top surface 14 of the hole bar 10 is not critical, as long as relatively uniform coverage of the web is provided, and the impingement of air is not directly over the center of the pressure pad generated by an opposing air bar. The percent open area of a hole bar or an air bar is defined by the following equation:

$$\left[ \sum_{i=1}^{j} A_{csperf_i} n_i \right] / A_{top} \times 100$$

Where:

j=number of perforation types $A_{csperf}$=cross-sectional area of a perforation type n=number of copies of a perforation type $A_{top}$=exterior surface area of hole or air bar top where perforations are located The percent open area of the hole bar 10 is from 1.8 to about 7.5% of the total area of the hole bar, preferably about 2.4% of the total area of the hole bar. The total dryer effective open area is defined by the following equation:

$$\left[ \sum_{i=1}^{j} (A_{open_i})(n_i)(C_{d_i}) \right] / A_{surface\ web\ heated} \times 100$$

Figure 5:
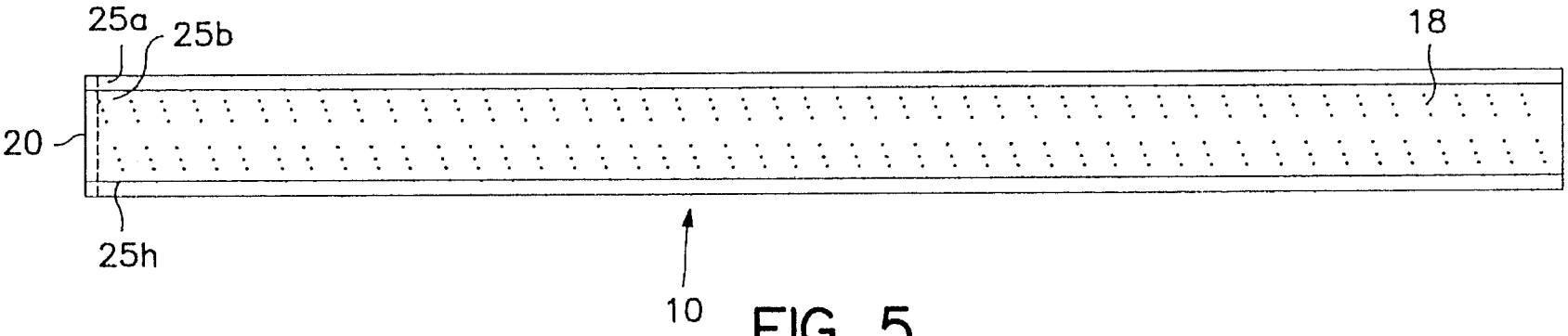
FIG. 5 is a top view of the preferred embodiment of the hole bar in accordance with the present invention.
Figure 12:
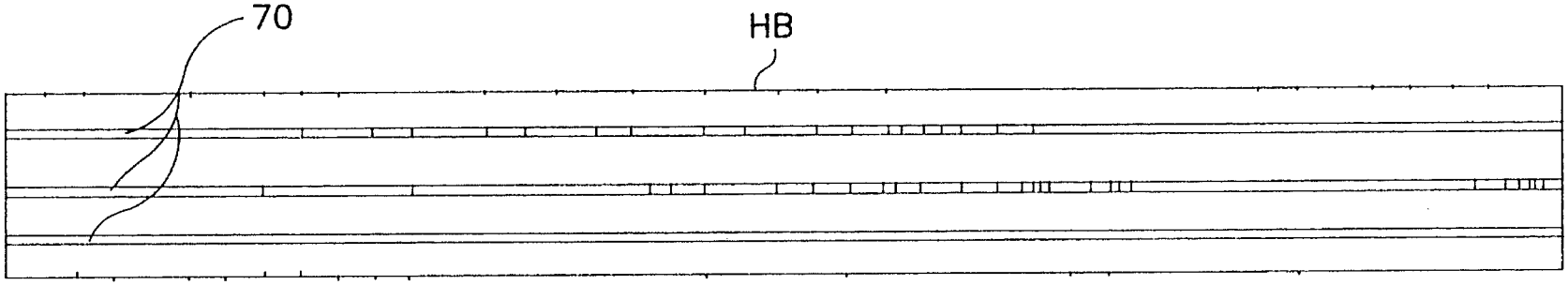
FIG. 12 is a top view of a direct impingement nozzle in accordance with an alternative embodiment of the present invention.

Where:

$A_{open}$=% open area/100×$A_{top}$ of bar type n=number of duplicates of a bar type j=number of bar types in dryer $C_d$=discharge coefficient of bar type $A_{surface\ web\ heated}$=total surface area of web being heated The dryer effective open area can be based on measured or calculated discharge coefficients, and is preferably in the range of 1.4 to 4%, most preferably 1.5% of the total web surface area being heated in the dryer enclosure. In the embodiment shown in FIG. 5, the hole bar open area is accomplished with 8 horizontal rows **25*a*–25*h* of circular holes 18, each horizontal row of holes 18 consisting of 31 holes spaced at 1.83 inch intervals. It should be understood by those skilled in the art that the number of rows of holes and the number of holes per row can vary, depending in part upon the size of the hole bar for the application. In the embodiment shown, the top row 25*a* commences 0.488 inches from the side edge 20 of the hole bar, and 0.421 inches from the top and bottom edges 21*a* and 21*b*. Each subsequent horizontal row 25*b*–25*h* is spaced an additional 0.229 inches from the side edge 20. Each horizontal row 25*a*–25*h*** is vertically spaced 0.454 inches from its neighboring row, except the rows nearest the center of the bar. In order to reduce web disturbance at close spacing to the web, it is preferred that the center of the hole bar be devoid of holes. Preferably the dimensions of this central portion devoid of holes is such that two symmetrical rows of holes could be accomodated therein if such holes were present.

Where the apertures of the hole bar are of a different configuration, such as diamonds, square or rectangular slots, preferably they have an equivalent diameter of from about 0.06 to 0.5 inches. Also, the slots 70 can be continuous along the length of the bar, a shown in FIG. 12.

Figure 10A:
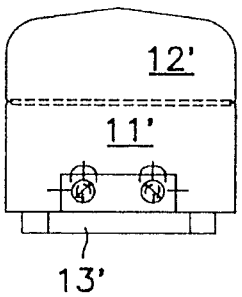
FIG. 10*a* is a front view of the nozzle of FIG. 10.
Figure 10:
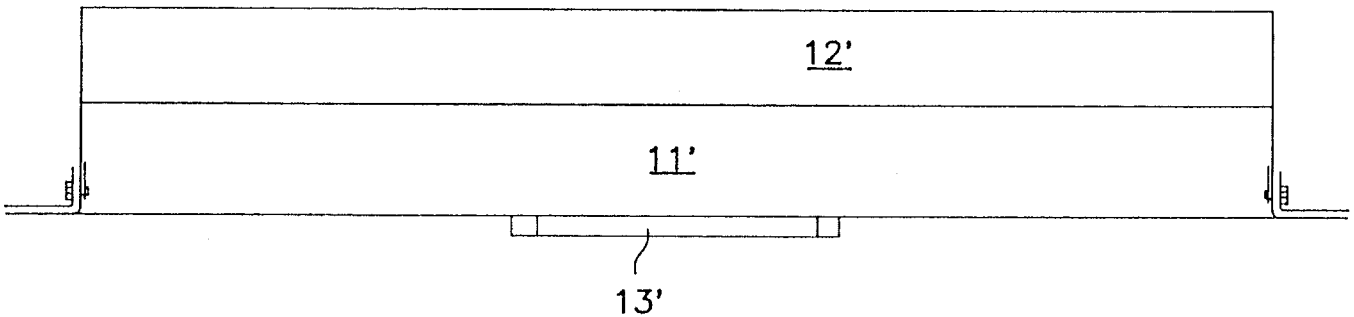
FIG. 10 is a side-view of a center feed direct impingement nozzle.

Although an end feed hole bar is shown in FIG. 4, a center feed design such as that illustrated in FIG. 10 can also be used, depending upon the application.

Depending upon the size of the holes 18, "whistling" and web fluting or wrinkling problems, particularly in the machine-direction, can arise. These problems should be minimized without compromising good flotation and heat transfer characteristics. Hole diameters of 0.164, 0.172 amd 0.1875 inches result in minimal web fluting and whistling in graphic arts applications, with hole diameters of 0.1875 inches being especially preferred. The optional use of a hole bar diffuser plate (not shown) coupled to flanges 9 (FIG. 3) between the header 11 and the compartment 12 may also be used in reducing whistle. A flow straightener 30 may also be positioned in chamber 12 of hole bar 10 to improve the air flow characteristics.

Also of importance in optimizing flotation and heat transfer characteristics is the height of the hole bars 10 from the web W. If the hole bars are too close to the web centerline, web instability and web touch-down on the air bar top can occur. However, moving the hole bars too far away from the web centerline can cause an undesirable loss in heat transfer. Accordingly, preferably the hole bar should be from about 2 to about 10 equivalent aperture diameters (or slot widths) away from the web. Actual hole bar clearances ranging from about ⅛ to 1¾ inches from the web are preferred. In general, a smaller web clearance, preferably less than 0.5 inches, is required for the air bar/hole bar arrangement embodiment shown in FIG. 2 where hole bar aperture diameters are 0.1875 inches and the hole bars are positioned without an opposite air bar, and a web clearance greater than 0.5 inches, preferably 0.875 inches is preferred for the embodiment in FIG. 2 where hole bar aperture diameters are 0.1875 and the hole bars are directly opposed by an air bar. In this latter embodiment, it is also preferred that the air bar slots be in the range from 0.085 or 0.095 inches. Accordingly, the height/diameter ratio in the embodiment where the hole bar is not directly opposed is less than 3, such as about 0.7 to about 2.7. The height/diameter ratio in the embodiment where the hole bar is directly opposed is from greater than 3 to about 10, preferably about 4.7.

Suitable nozzle velocity is in the range of 1000 to 12000 feet per minute, with a nozzle velocity of from about 8000 to 10000 fpm being preferred.

Figure 11:
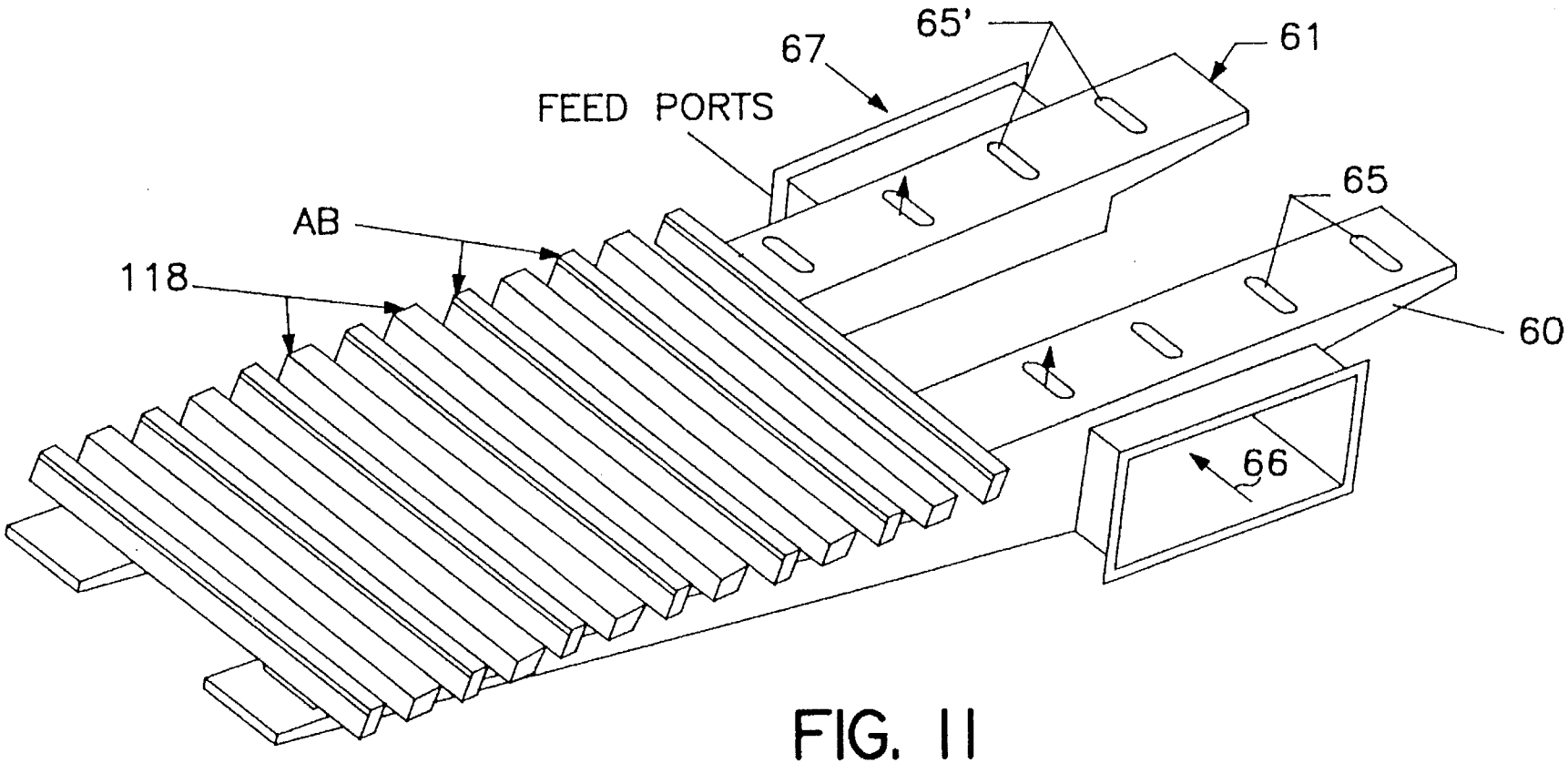
FIG. 11 is a perspective view of an air bar/hole bar combination in accordance with an alternative embodiment of the present invention.

The air bars and hole bars need not be fed by the same header systems; separate headers can be used as shown in FIG. 11, especially if different operating velocities and/or air temperatures in the hole bars and air bars are desired. A first tapered header 60 having a plurality of feed ports 65 is an air receiving communication with air bars AB. Air supply is fed to the header 60 in the direction of arrow 66. A second tapered header 61 having a plurality of feed ports 65' is in air receiving communication with hole bars HB. Air supply is fed to the header 61 in the direction of arrow 67. Independent control of velocities may be important where heat transfer and flotation requirements are at odds, such as where low web tensions require reduced flotation velocity, yet the heat transfer required remains the same.

Figure 6:
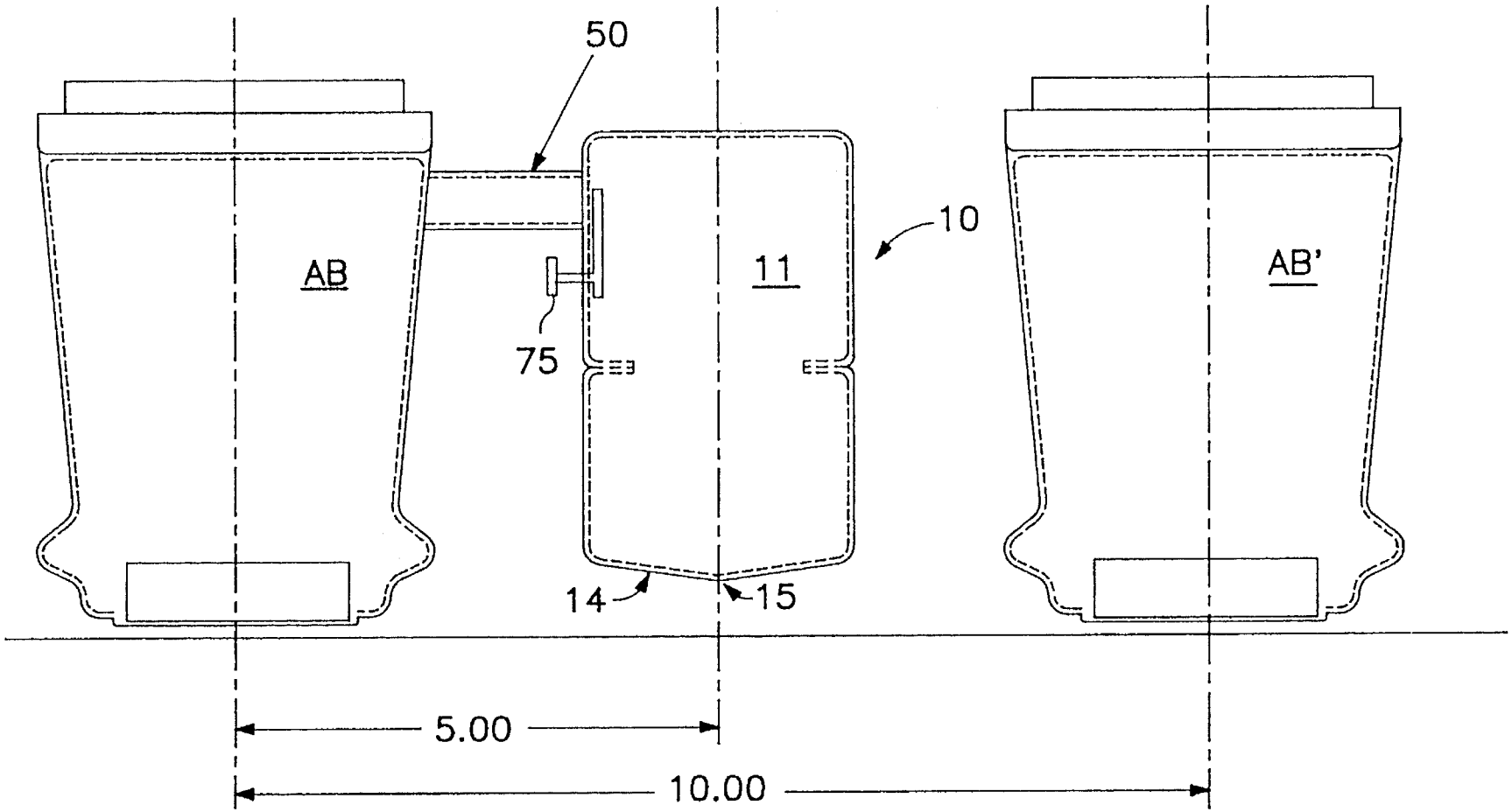
FIG. 6 is a cross-sectional view of a combined flotation nozzle/direct impingement nozzle in accordance with one embodiment of the present invention.

Similarly, the air bars and hole bars can be separately dampered such that they operate at different nozzle velocities. In the embodiment shown in FIG. 6, the hole bar 10 is integral to a flotation nozzle AB, with a hole bar supply duct 50 feeding the latter from the flotation nozzle AB. In the embodiment shown, the center of the hole bar 10 is spaced five inches from the center of the flotation nozzle AB, which in turn is spaced ten inches from the flotation nozzle AB'. The flotation nozzle/hole bar integral configuration is preferred for retrofitting existing graphic arts dryers having conventional center feed headers. Since a larger volume of air must enter the flotation nozzle having the hole bar attached, the pressure losses through each air feed path must be examined and controlled to supply the proper air flow rate to each device. One way to control air flow to each device is to use dampers, such as at 75, in each air bar and hole bar. The air flow may also be controlled by proper design of each diffuser plate. Each flow path is examined and the pressure drop through each path is balanced by selecting the appropriate percent open area of the diffuser plate required to provide the balancing pressure drop.

For non-graphic arts applications, some materials such as metal webs allow for use of much larger diameter holes, since such webs are not fragile and usually have high tensions pulling the web flat. Suitable aperture equivalent diameters may be as large as 0.5 inches for such applications, since the web will not flute or wrinkle and large size apertures provide a more economical hole bar. In some process coating applications, uniformity of drying is critical, in which case continuous slots rather than discrete holes are preferred.

EXAMPLE 1

Figure 7:
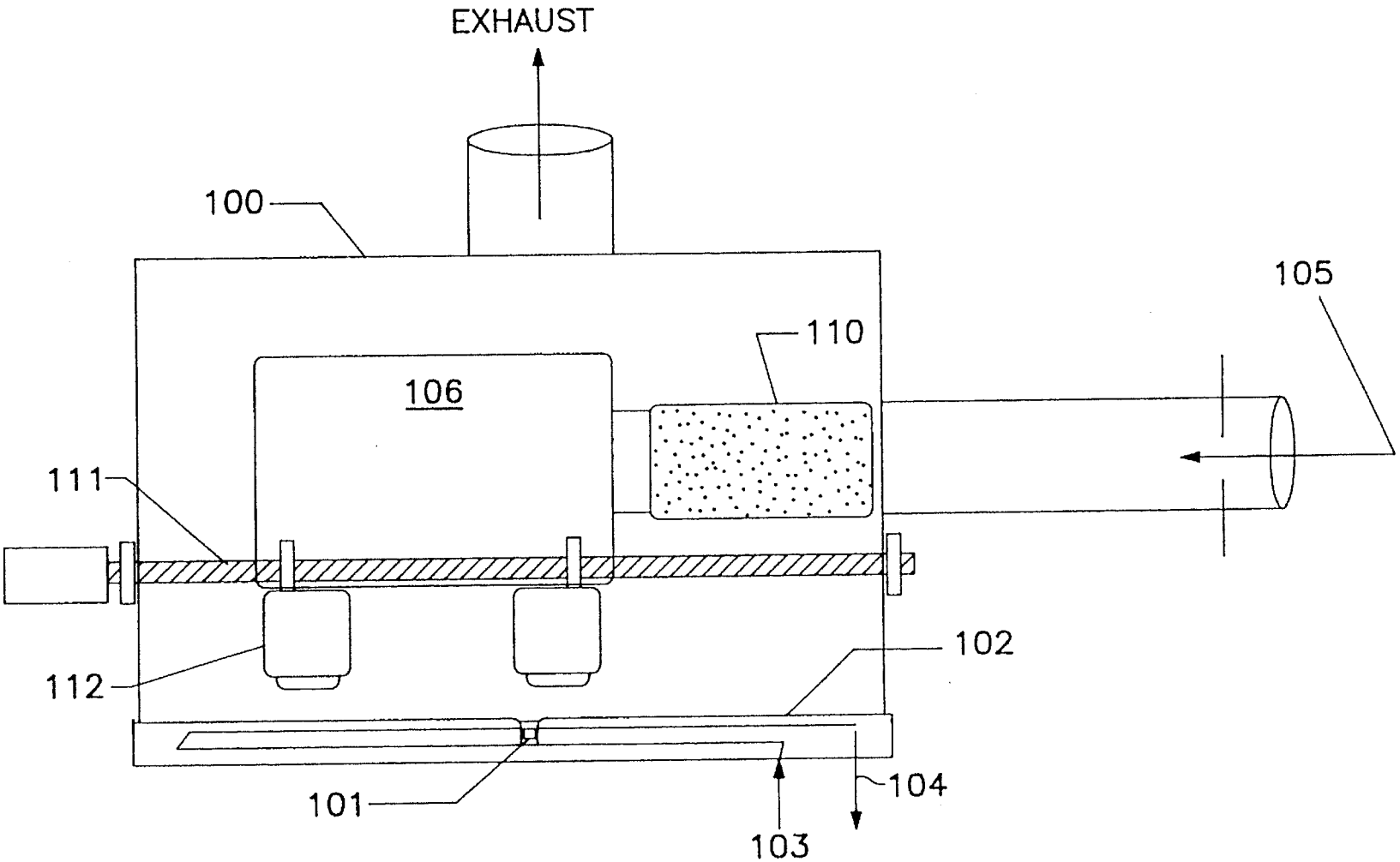
FIG. 7 is a schematic view of the test apparatus used to measure heat transfer coefficients.

A bench-scale test stand was used to measure the local heat transfer characteristics for single and paired nozzles. A schematic drawing of the test stand 100 is shown in FIG. 7. The test stand 100 is comprised of a calibrated heat flux sensor 101 mounted flush with the surface of a plate 102 which represents the heat transfer surface. The surface temperature of the plate 102 is maintained constant by a flow of chilled water, illustrated by arrows 103,104. A hot air source delivers supply air (depicted by arrow 105) at a controlled temperature through a flexible duct 110 to a traversing header assembly 106 located above the plate 102. The traversing header assembly 106 includes a traversing mechanism 111. The header 106 allows for the mounting of different styles of nozzles 112 at a range of nozzle-to-plate clearances and spacings of nozzles when pairs are tested.

The header 106 traverses the plate 102 and measurements of the local heat flux are recorded at intervals, typically ⅛" (3.2 mm). The local heat flux is measured by heat flux sensor 101. The measured local heat transfer coefficient values are defined as:

$$h_L = \text{Local Mesaured Flux}/[T_{air} - T_{sensor}]$$

The test apparatus involves convective heating of a cool surface. The entrainment of cooler ambient air must be avoided, otherwise the temperature driving force cannot be accurately determined from the supply air temperature. Also to be considered is the handling of spent air from the nozzles, especially for multiple nozzle arrays. Accordingly, the test stand is enclosed so that the results are representative of heating webs in flotation dryers and similar oven arrangements.

For a fixed heat transfer coefficient, a comparison of the power requirements, nozzle velocity and air flow was made as between standard 1× air bars spaced 10 inches apart (10" pitch) and having a 0.25" web clearance, and standard 1× air bars spaced 14 inches apart (14" pitch) and having a 0.25" web clearance with a hole bar centered between the two air bars at a 0.75" web clearance. A 3.3% open area hole bar was used with 0.164" diameter holes. The following Table 1 depicts the data.

TABLE 1

| h Btu/hr/ft²/F | Nozzle Arrangement | Nozzle Velocity (fpm) | acfm/ft²* | hp/ft² |
|---|---|---|---|---|
| 28 | 1X air bars, 10" pitch | 12000 | 124 | 0.152 |
| 28 | 1X air bars, 14" pitch, 3.3% open area hole bars with 0.164" diameter holes | 8000 | 122 | 0.060 |

*acfm is the volume rate of air flow (ft³/min) for a given nozzle arrangement. To compare this to the air flow used by another nozzle configuration, the volume flow must be divided by the test area to give the volume flux of air flow which is a normalized, directly comparable value.

The data show that the nozzle velocity is much lower for the air bar/hole bar combination, which is desirable since at lower velocities, the air forces are not as disturbing to the web. Note that the air bar/hole bar combination requires only 40% of the power of the standard air bar arrangement.

EXAMPLE 2

Figure 8:
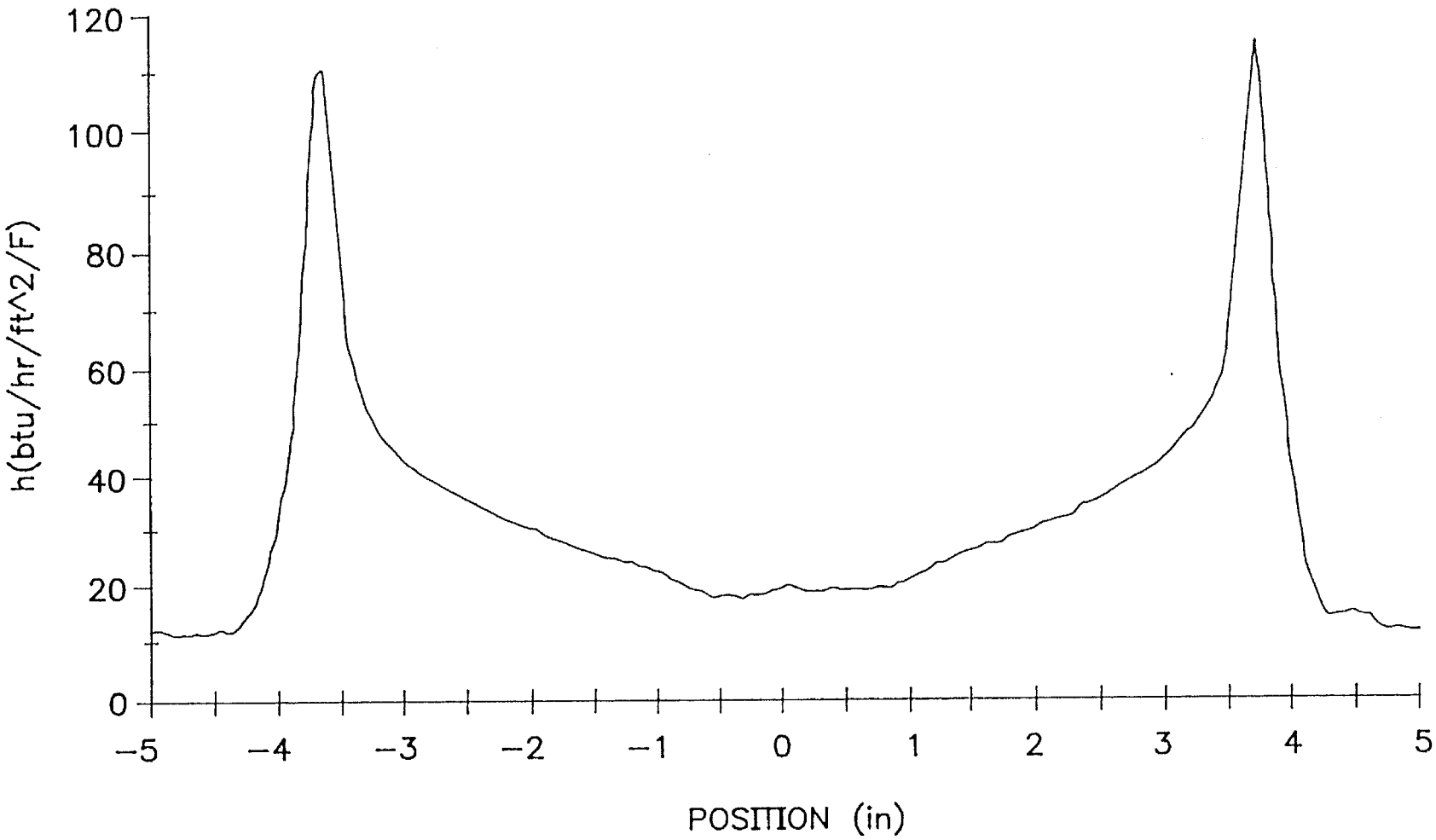
FIG. 8 is a graphical illustration of the test results for standard 1× air bars.
Figure 9:
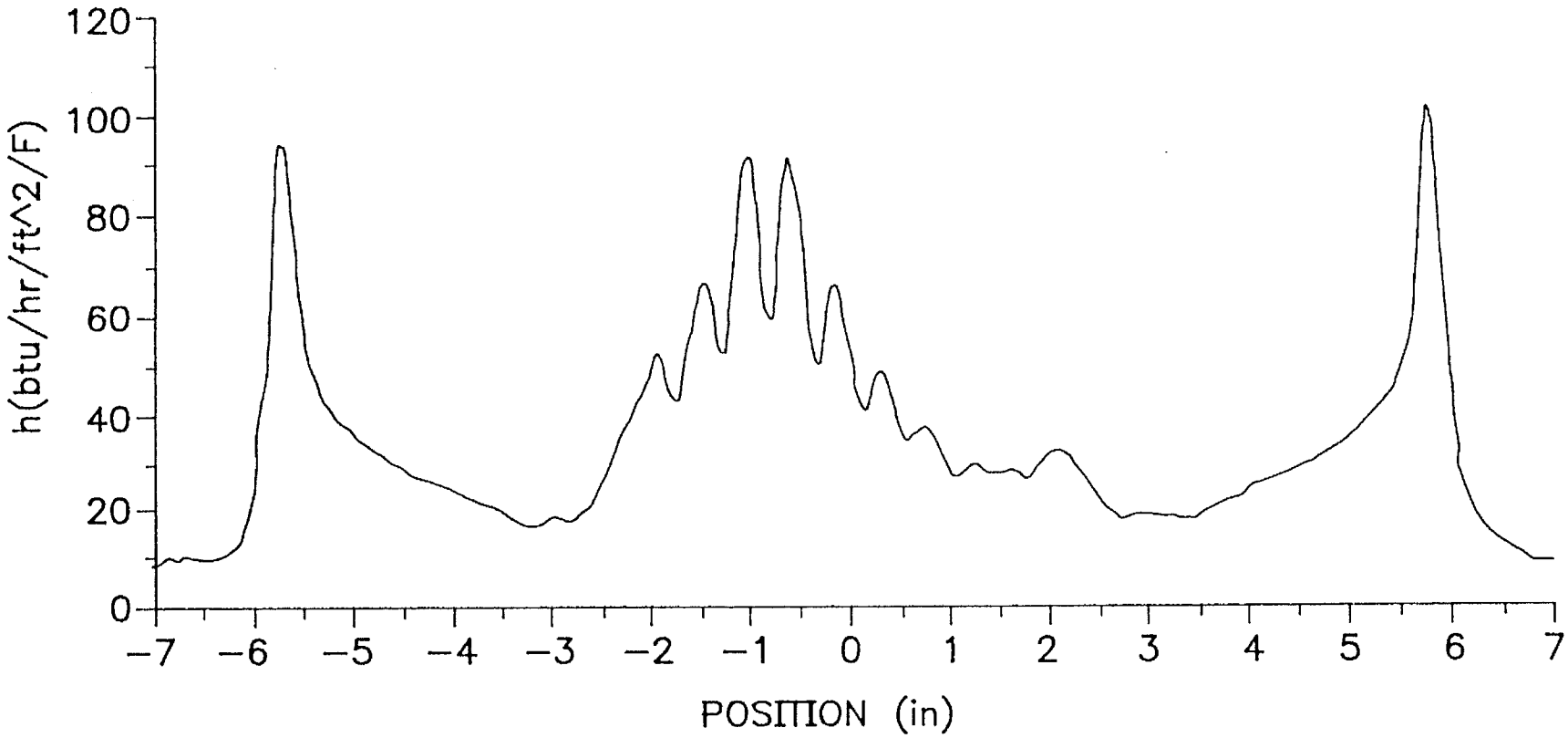
FIG. 9 is a graphical illustration of the test results for an air bar and a hole bar combination in accordance with the present invention.

A number of measurements were made of the local heat transfer coefficients for 1× air bars and hole bars using the bench test stand. All measured heat transfer coefficients have been corrected for thermal radiation effects. This correction was estimated at 1.2 Btu/hr/ft²/°F. (6.8 W/m²/°C.) for the 210° F. (99° C.) air temperature and 70° F. (21° C.) plate temperature used for the experiments. The results are shown in FIGS. 8 and 9 as a plot of heat transfer coefficient versus "Position". "Position" is with reference to the center of the nozzle array being tested. A traverse of the nozzles is conducted with respect to the fixed heat flux sensor. This allows local heat transfer measurements.

A comparison of FIGS. 8 and 9 shows that with the hole bar mounted between two air bars, the center of the plot has higher local heat transfer rates. The tests were conducted using comparable air flow rates.

What is claimed is:

1. Apparatus for floatingly drying a running web, said apparatus comprising an array of nozzles comprising, in combination, a plurality of flotation nozzles for floatingly supporting said web, and a plurality of direct impingement nozzles for drying said web, said direct impingement nozzles comprising a top surface having a plurality of apertures representing a total open area of from 1.8 to about 7.5% of the total area of said top surface, at least one of said direct impingement nozzles being opposed by a flotation nozzle and having a height/diameter ratio of from greater than 3 to about 10.

2. The apparatus of claim 1 wherein said height/diameter ratio is 4:7.

3. The apparatus of claim 1 wherein at least one of said direct impingement nozzles is not opposed by a flotation nozzle, and wherein the height/diameter ratio of said at least one direct impingement nozzle is less than 3.

4. The apparatus of claim 1 wherein said top surface of each of said direct impingement nozzles comprises a central portion devoid of apertures.

5. The apparatus of claim 1, wherein said top surface is crown shaped having a central apex at about a 0° to 10° angle.

6. The apparatus of claim 5, wherein said top surface is crown shaped having a central apex at a 5° angle.

7. The apparatus of claim 1 wherein the equivalent diameter of each of said plurality of apertures is from 1/16 to ½ inches.

8. The apparatus of claim 1 further comprising a dryer enclosure housing said array of nozzles, and wherein said dryer has effective open area of from 1.4 to about 4%.

9. The apparatus of claim 1, wherein at least one of said plurality of direct impingement nozzles is positioned between two flotation nozzles.

10. The apparatus of claim 1, wherein each flotation nozzle is spaced about 10 to about 30 inches from another flotation nozzle.

11. The apparatus of claim 1, wherein said apertures are continuous slots.

12. The apparatus of claim 1, wherein each of said direct impingement nozzles is in air receiving communication with a flotation nozzle.

13. Apparatus for floatingly drying a running web, said apparatus comprising: first and second opposed arrays of nozzles for floatingly supporting and drying a web running therebetween, each array comprising a plurality of direct impingement nozzles and a plurality of air flotation nozzles, said direct impingement nozzles comprising a top surface having a plurality of apertures representing a total open area of from 1.8 to about 7.5% of the total area of said top surface, said direct impingment nozzles being selected from the group consisting of hole array bars and slot bars.

14. The apparatus of claim 13 wherein each of said first array comprises a direct impingement nozzle opposite an air flotation nozzle on said second array.

15. The apparatus of claim 14 wherein said first array direct impingement nozzle located opposite a second array air flotation nozzle is further located between air flotation nozzles on said first array.

16. The apparatus of claim 13 wherein a direct impringement nozzle is opposed by a flotation nozzle have a height/diameter ratio of 3 to 10.

17. Apparatus for floatingly drying a running web, said apparatus comprising: first and second opposed arrays of nozzles for floatingly supporting and drying a web running therebetween, each array comprising a plurality of direct impingement nozzles and a plurality of air flotation nozzles, said direct impingement nozzles comprising a top surface having a plurality of apertures, said top surface having a crown shape.

18. The apparatus of claim 17 wherein said crown shape further comprises a central apex.

19. The apparatus of claim 18 wherein said crown shape has an angle from about 0° to about 10°.

* * * * *